US005382504A

United States Patent [19]

Shor et al.

[11] Patent Number: 5,382,504

[45] Date of Patent: Jan. 17, 1995

[54] PHOTOTHERMOGRAPHIC ELEMENT WITH CORE-SHELL-TYPE SILVER HALIDE GRAINS

[75] Inventors: Steven M. Shor, Woodbury; Chaofeng Zou, Maplewood; Pu Zhou, Woodbury, all of Minn.; Shozo Aoki, Machida, Japan

[73] Assignee: Minnesota Mining and Manufacturing Company, St. Paul, Minn.

[21] Appl. No.: 199,114

[22] Filed: Feb. 22, 1994

[51] Int. Cl.[6] ..... G03C 1/498

[52] U.S. Cl. ..... 430/619; 430/567; 430/613

[58] Field of Search ..... 430/567, 619, 600, 613

[56] References Cited

U.S. PATENT DOCUMENTS

| | | | |
|---|---|---|---|
| 3,180,731 | 4/1965 | Roman et al. . | |
| 3,457,075 | 7/1969 | Morgan et al. . | |
| 3,531,286 | 9/1970 | Renfrew . | |
| 3,589,903 | 6/1971 | Birkeland . | |
| 3,761,270 | 9/1973 | Maurial et al. . | |
| 3,839,049 | 10/1974 | Simons . | |
| 3,846,136 | 11/1974 | Sullivan . | |
| 3,994,732 | 11/1976 | Winslow . | |
| 4,021,240 | 5/1977 | Corquoni et al. . | |
| 4,022,617 | 5/1977 | McGuckin . | |
| 4,152,160 | 5/1979 | Ikienoue et al. . | |
| 4,187,108 | 2/1980 | Willis . | |
| 4,212,937 | 7/1980 | Akashi et al. | 430/613 |
| 4,260,677 | 4/1981 | Winslow et al. . | |
| 4,374,921 | 2/1983 | Frenchik . | |
| 4,426,441 | 1/1984 | Adin et al. . | |
| 4,460,681 | 7/1984 | Frenchik et al. . | |
| 4,565,778 | 1/1986 | Miyamoto et al. | 430/569 |
| 4,883,747 | 11/1989 | Grieve et al. . | |
| 4,963,467 | 10/1990 | Ishikawa et al. | 430/567 |
| 5,028,523 | 7/1991 | Shoy | 430/617 |
| 5,064,753 | 11/1991 | Sohei et al. | 430/617 |

FOREIGN PATENT DOCUMENTS

| | | |
|---|---|---|
| 61-129642 | 6/1986 | Japan . |
| 62-103634 | 5/1987 | Japan . |
| 62-150240 | 7/1987 | Japan . |
| 62-229241 | 10/1987 | Japan . |
| 63-300234 | 12/1988 | Japan . |

OTHER PUBLICATIONS

*Research Disclosure* #29963, Mar. 1989.

*Primary Examiner*—Thorl Chea

*Attorney, Agent, or Firm*—Gary L. Griswold; Walter N. Kirn; Gregory A. Evearitt

[57] ABSTRACT

A negative-acting photothermographic element comprising a support bearing at least one heat-developable, photosensitive, image-forming photothermographic emulsion layer comprising:

(a) core-shell-type, photosensitive silver halide grains containing a total silver iodide content of less than 4 mole %, the core having a tint silver iodide content of from about 4–14 mole %, the shell having a second silver iodide content lower than the silver iodide content of the core;

(b) a non-photosensitive, reducible source of silver;

(c) a reducing agent for the non-photosensitive, reducible source of silver;

(d) a binder; and (e) at least one compound selected from the group consisting of: a halogen molecule; an organic haloamide; and hydrobromide acid salts of nitrogen-containing heterocyclic compounds which are further associated with a pair of bromine atoms.

23 Claims, No Drawings

PHOTOTHERMOGRAPHIC ELEMENT WITH CORE-SHELL-TYPE SILVER HALIDE GRAINS

BACKGROUND OF THE INVENTION

1. Field of the Invention

This invention relates to a photothermographic element and in particular, it relates to a photothermographic element containing core-shell-type silver halide grains.

2. Background to the Art

Silver halide containing photothermographic imaging materials (i.e., heat-developable photographic elements) processed with heat, and without liquid development, have been known in the art for many years. These materials, also known as "dry silver" compositions or emulsions, generally comprise a support having coated thereon: (1) a photosensitive material that generates elemental silver when irradiated; (2) a non-photosensitive, reducible silver source; 3) a reducing agent for the non-photosensitive reducible silver source; and (4) a binder. The photosensitive material is generally photographic silver halide which must be in catalytic proximity to the non-photosensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that elemental silver ($Ag^{\circ}$) is a catalyst for the reduction of silver ions, and the photosensitive photographic silver halide may be placed into catalytic proximity with the non-photosensitive, reducible silver source in a number of different fashions, such as by partial metathasis of the reducible silver source with a halogen-containing source (see, for example, U.S. Pat. No. 3,457,075); co-precipitation of silver halide and reducible silver source material (see, for example, U.S. Pat. No. 3,839,049); and other methods that intimately associate the photosensitive photographic silver halide and the non-photosensitive, reducible silver source.

In both photographic and photothermographic emulsions, exposure of the photographic silver halide to light produces small clusters of silver atoms ($Ag^{\circ}$). The imagewise distribution of these clusters is known in the art as a latent image. This latent image generally is not visible by ordinary means and the photosensitive emulsion must be further processed in order to produce a visible image. The visible image is produced by the reduction of silver ions, which are in catalytic proximity to silver halide grains beating the clusters of silver atoms, i.e. the latent image. This produces a black-and-white image.

The non-photosensitive, reducible silver source is a material that contains silver ions. The preferred non-photosensitive, reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates, have been proposed, and U.S. Pat. No. 4,260,677 discloses the use of complexes of inorganic or organic silver salts as non-photosensitive, reducible silver sources.

As the visible image is produced entirely by elemental silver ($Ag^{\circ}$), one cannot readily decrease the amount of silver in the emulsion without reducing the maximum image density. However, reduction of the amount of silver is often desirable in order to reduce the cost of raw materials used in the emulsion.

One method of attempting to increase the maximum image density in black-and-white photographic and photothermographic emulsions without increasing the amount of silver in the emulsion layer is by incorporating toning agents into the emulsion. Toning agents improve the color of the silver image of the photothermographic emulsions, as described in U.S. Pat. Nos. 3,846,136; 3,994,732; and 4,021,249.

Another method of increasing the maximum image density of photographic and photothermographic emulsions without increasing the amount of silver in the emulsion layer is by incorporating dye-forming materials in the emulsion. For example, color images can be formed by incorporation of leuco dyes into the emulsion. Leuco dyes are the reduced form of a color-bearing dye. Upon imaging, the leuco dye is oxidized, and the color-bearing dye and a reduced silver image are simultaneously formed in the exposed region. In this way a dye enhanced silver image can be produced, as shown, for example, in U.S. Pat. Nos. 3,531,286; 4,187,108; 4,426,441; 4,374,921; and 4,460,681.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747; and Research Disclosure, March 1989, item 29963.

With the increased availability of low-irradiance light sources such as light emitting diodes (LED), cathode ray tubes (CRT), and semi-conductor laser diodes, have come efforts to produce high-speed, photothermographic elements which require shorter exposure times. Such photothermographic systems would find use in, for example, conventional black-and-white or color photothermography, in electronically-generated black-and-white or color hardcopy recording, in graphic arts laser recording, for medical diagnostic laser imaging, in digital color proofing, and in other applications.

Various techniques are typically employed to try and gain higher sensitivity in a photothermographic material. These techniques center around making the silver halide crystals' latent image centers more efficient such as by introducing imperfections into the crystal lattice or by chemical sensitization of the silver halide grains and by improving the sensitivity to particular wavelengths of light by formulating new improved sensitizing dyes or by the use of supersensitizers.

In efforts to make more sensitive photothermographic materials, one of the most difficult parameters to maintain at a very low level is the various types of fog or $D_{min}$. Fog is spurious image density which appears in non-developmentally sensitized areas of the element and is often reported in sensitometric results as $D_{min}$. Photothermographic emulsions, in a manner similar to photographic emulsions and other light-sensitive systems, tend to suffer from fog.

Traditionally, photothermographic materials have suffered from fog upon coating. The fog level of freshly prepared photothermographic elements will be referred to herein as initial fog or initial $D_{min}$.

In addition, the fog level of photothermographic elements often rises as the material is stored, or "ages." This type of fog will be referred to herein as shelf-aging fog. Adding to the difficulty of fog control on shelf-aging is the fact that the developer is incorporated in the photothermographic element. This is not the case in most silver halide photographic systems. A great amount of work has been done to improve the shelf-life characteristics of photothermographic materials.

A third type of fog in photothermographic systems results from the instability of the image after processing. The photoactive silver halide still present in the developed image may continue to catalyze formation of metallic silver (known as "silver print-out") during room light handling or post-processing exposure such as in graphic arts contact frames. Thus, there is a need for post-processing stabilization of photothermographic materials.

Without having acceptable resistance to fog, a commercially useful material is difficult to prepare. Various techniques have been employed to improve sensitivity and maintain resistance to fog.

U.S. Pat. No. 4,212,937 describes the use of a nitrogen-containing organic base in combination with a halogen molecule or an organic haloamide to improve storage stability and sensitivity.

Japanese Patent Kokai 61-129642, published Jun. 17, 1986, describes the use of halogenated compounds to reduce fog in color-forming photothermographic emulsions. These compounds include acetophenones such as phenyl($\alpha$,$\alpha$-dibromobenzyl)ketone.

U.S. Pat. No. 4,152,160 describes the use of carboxylic acids, such as benzoic acids and phthalic acids, in photothermographic elements. These acids are used as antifoggants.

U.S. Pat. No. 3,589,903 describes the use of small amounts of mercuric ion in photothermographic silver halide emulsions to improve speed and aging stability.

U.S. Pat. No. 4,784,939 describes the use of benzoic acid compounds of a defined formula to reduce fog and to improve the storage stability of silver halide photothermographic emulsions. The addition of halogen molecules to the emulsions are also described as improving fog and stability.

U.S. Pat. No. 5,064,753 discloses a thermally-developable, photographic material containing core-shell-type silver halide grains that contain a total of 4–40 mole % of silver iodide and which have a lower silver iodide content in the shell than in the core. Incorporating silver iodide into the silver halide crystal in amounts greater than 4 mole % is reported to result in increased photosensitivity and reduced $D_{min}$. The silver halide itself is the primary component reduced to silver metal during development. The shelf stability properties of the preferred formulations is not addressed. This material is primarily used for color applications.

Japan Patent Kokai 63-300,234, published Dec. 7, 1988, discloses a heat-developable, photosensitive material containing a photosensitive silver halide, a reducing agent, and a binder. The photosensitive silver halide has a silver iodide content of 0.1–40 tool % and a core/shell grain structure. The photosensitive silver halide grains are further sensitized with gold. The material is reported to afford constructions with good sensitivity and low fog.

Japan Kokai 62-103,634, published May, 14, 1987; Japan Kokai 62–150,240, published Jul. 4, 1987; and Japan Kokai 62-229,241, published Oct. 8, 1987, describe heat-developable photosensitive materials incorporating core-shell grains with an overall iodide content greater that 4 mol %.

U.S. Pat. No. 5,028,523 discloses radiation-sensitive, thermally-developable imaging elements comprising; a photosensitive silver halide; a light-insensitive silver salt oxidizing agent; a reducing agent for silver ion; and an antifoggant or speed enhancing compound comprising hydrobromic acid salts of nitrogen-containing heterocyclic compounds which are further associated with a pair of bromine atoms. These antifoggants are reported to be effective in reducing spurious background image density.

SUMMARY OF THE INVENTION

The present invention provides heat-developable, photothermographic elements capable of providing high photographic speed; stable, high density images of high resolution and good sharpness; and good shelf stability.

It has now been discovered that core-shell-type silver halide grains with certain concentrations of silver iodide in the core and in the shell, when used in conjunction with either a halogen molecule; an organic haloamide compound; or compounds comprising hydrobromic acid salts of nitrogen-containing heterocyclic compounds which are further associated with a pair of bromine atoms, .give enhanced photothermographic properties when used as part of a preformed dry silver soap formulation. By controlling the amounts and ratio of silver iodide in both the core and the shell, significant improvement over non-core-shell type emulsions in sensitometric properties such as speed $D_{min}$ (i.e., lower initial fog), and shelf-life stability (i.e., shelf-aging fog) have been obtained while retaining the desired high sensitivity and $D_{max}$.

These negative-acting, heat-developable, photothermographic elements comprise a support bearing at least one photosensitive, image-forming, photothermographic emulsion layer comprising:

(a) core-shell-type, photosensitive silver halide grains containing a total silver iodide content of less than 4 mole %, the core having a first silver iodide content of from about 4–14 mole %, the shell having a second silver iodide content lower than the silver iodide content of the core;

(b) a non-photosensitive, reducible source of silver;

(c) a reducing agent for the non-photosensitive, reducible source of silver;

(d) a binder; and (e) at least one compound selected from the group consisting of: a halogen molecule; an organic haloamide compound; and hydrobromic acid salts of nitrogen-containing heterocyclic compounds which are further associated with a pair of bromine atoms.

The reducing agent for the non-photosensitive, reducible source of silver may optionally comprise a compound capable of being oxidized to form or release a dye. Preferably, the dye-forming material is a leuco dye.

The core-shell-type photosensitive type silver halide grains used in the present invention should have an overall silver iodide content of less than 4 mole %. The silver iodide content in the core grains is within the range of 4–14 mole %, and preferably, within the range of 6–10 mole %. For the silver halide composition of the shell, the silver iodide content is preferably within the range of 0–2 mole %.

In contrast to the above-mentioned U.S. Pat. No. 5,064,753, the present invention provides a system based on core-shell-type silver halide acting only as a photosensitive catalyst for a non-photosensitive, reducible source of silver (such as silver behenate) which is reduced to become the primary source of metallic silver in the system.

Other aspects, advantages, and benefits of the present invention are apparent from the detailed description, the examples, and the claims.

DETAILED DESCRIPTION OF THE INVENTION

The negative-acting photosensitive element of the present invention comprises a support having at least one photosensitive, image-forming, photothermographic emulsion layer comprising:

(a) core-shell-type, photosensitive silver halide grains containing a total silver iodide content of less than 4 mole %, the core having a first silver iodide content of from about 4–14 mole %, the shell having a second silver iodide content lower than the silver iodide content of the core;

(b) a non-photosensitive, reducible source of silver;

(c) a reducing agent for the non-photosensitive, reducible source of silver;

(d) a binder; and (e) at least one compound selected from the group consisting of a halogen molecule; an organic haloamide compound; or hydrobromic acid salts of nitrogen-containing heterocyclic compounds which are further associated with a pair of bromine atoms.

The reducing agent for the non-photosensitive, reducible silver source may optionally comprise a compound capable of being oxidized to form or release a dye. Preferably, the dye forming material is a leuco dye.

Improvements in photothermographic properties can be attained by utilizing core-shell-type (sometimes referred to as "layered") silver halide grains where the core contains 4–14 mole % silver iodide and the shell contains a lesser amount of silver iodide with the requirement that the total silver iodide contained in the silver halide grains is less than 4 mole %. Preferably, the core comprises up to 50 mole % of the total silver halide content in the silver halide grains. The grains may be grown by any variety of known procedures and to any grain size, however, it is preferable to grow grains that are less than 0.1 μm (0.1 micron or 0.1 micrometer). Grains of reduced size result in reduced haze and lower $D_{min}$. When used with compounds comprising hydrobromic acid salts of nitrogen-containing heterocyclic compounds; a halogen molecule; or an organic haloamide compound which are further associated with a pair of bromine atoms, the present invention provides heat-developable, photothermographic elements capable of providing high photographic speed, stable, high density images of high resolution, good sharpness, and good shelf stability.

The photothermographic elements of this invention may be used to prepare black-and-whim, monochrome, or full-color images. The photothermographic element of this invention can be used, for example, in conventional black-and-white or color photothermography, in electronically-generated black-and-white or color hard-copy recording, in the graphic arts laser recording, for medical diagnostic laser imaging, in digital color proofing, and in other applications. The element of this invention provides high photographic speed, provides strongly absorbing black-and-white or color images, and provides a dry and rapid process while possessing low $D_{min}$.

The Photosensive Core-Shell-Type Silver Halide

The photosensitive silver halide grains used in the present invention are characterized by-their core-shell-type structure wherein the surface layer (such as in the form of a shell) has a lower silver iodide content than the internal phase or bulk (such as in the form of a core). If the silver content in the surface layer of the core-shell-type silver halide grains is higher than or equal to that in the internal phase, disadvantages such as increased $D_{min}$ and increased fog upon storage or shelf aging, (as often simulated by accelerated aging at elevated temperature) will occur.

There is no particular limitation on the types of silver halides other than silver iodide in the core of the photosensitive silver halide grains, but preferable examples are silver iodobromide and silver chloroiodobromide. The difference in silver iodide content between the surface layer (shell) and internal phase (core) of a silver halide grain may be abrupt, so as to provide a distinct boundary, or diffuse so as to create a gradual transition from one phase to the other.

The silver iodide-containing core of the photosensitive silver halide grains may be prepared by the methods described in various .references such as: P. Giafkides, *Chimie et Physique Photographique*, Paul Montel, 1967; G.E Duffin. *Photographic Emulsion Chemistry*, The Focal Press, 1966; and V.L. Zelikman et al., *Making and Coating Photographic Emulsions*, The Focal Press, 1964.

An emulsion of the core-shell-type silver halide grains used in the present invention may be prepared by first making cores from monodispersed photosensitive silver halide grains, then coating a shell over each of the cores. The term "monodispersed silver halide emulsion" as used in the present invention means an emulsion wherein the silver halide grains present have such a size distribution that the size variance with respect to the average particle size is not greater than the level specified below. An emulsion made of a photosensitive silver halide that consists of silver halide grains that are uniform in shape and which have small variance in grain size (this type of emulsion is hereinafter referred to as a "monodispersed emulsion") has a virtually normal size distribution and allows its standard deviation to be readily calculated. If the spread of size distribution (%) is defined by (standard deviation/ average grain size) ×100, then the monodispersed photosensitive silver halide grains used in the present invention preferably have a spread of distribution of less than 15% and, more preferably, less than 10%.

Monodispersed silver halide grains with desired sizes that serve as cores can be formed by using a "double-jet" method with the pAg being held at a constant level. In the double-jet method, the silver halide is formed by simultaneous addition of a silver source (such as silver nitrate) and a halide source (such as potassium chloride, bromide, or iodide) such that the concentration of silver (i.e., the pAg) is held at a constant level. Preparation of monodispersed silver halide grains using a double-jet method is described in Example 1 of this application.

A silver halide emulsion comprising highly monodispersed photosensitive silver halide grains to serve as cores for the core-shell-type emulsion may be prepared by employing the method described in Japanese Patent Application No. 48521/1979. A shell is then allowed to grow continuously on each of the thus prepared monodispersed core grains in accordance with the method employed in making the monodispersed emulsion. As a result, a silver halide emulsion comprising the monodispersed core-shell-type silver halide grains suitable for use in the present invention is attained.

While it suffices for the core-shell-type photosensitive silver halide grains used in the present invention to have a lower silver iodide content in the surface layer (shell) than in the internal phase (Core), the silver iodide content of the shell is preferably at least about 2–12 mole % lower than the silver iodide content of the core. The shell may be comprised of silver chloride, silver bromide, silver chlorobromide, or silver iodide.

The average size of the core-shell-type photosensitive silver halide grains used in the present invention is not limited to any particular value, but is preferably less than 0.1 μm in average diameter with the range of 0.02 to 0.08 μm being more preferable.

The average size of the photosensitive core-shell-type silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "*Particle Size Analysis,*" ASTM Symposium on Light Microscopy, R.P. Loveland, 1955, pp. 94–122; and in *The Theory of the Photographic Process*, C.E. Kenneth Mees and T.H. James, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Pre-formed core-shell-type silver halide emulsions in the element of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et at., U.S. Pat. No. 3,241,969; and Waller et at., U.S. Pat. No. 2,489,341. The silver halide grains may have any crystalline habit including, but not limited to, cubic, tetrahedral, orthorhombic, tabular, laminar, platelet, etc.

The shape of the photosensitive core-shell-type silver halide grains of the present invention is in no way limited; they may be normal crystals (such as cubes, tetradecahedrons and octahedrons), twinned, or tabular. If desired, a mixture of these crystals may be employed.

The light sensitive core-shell-type silver halide used in the present invention can be employed in a range of 0.005 mol to 0.5 mol and, preferably, from 0.01 mol to 0.15 mol, per mole of non-photosensitive reducible source of silver. The silver halide may be added to the emulsion layer in any fashion which places it in catalytic proximity to the non-photosensitive reducible source of silver.

Addition of sensitizing dyes to the core-shell-type silver halides of this invention serves to provide them with high sensitivity to visible and infra-red light by spectral sensitization. The photosensitive silver halides may be spectrally sensitized with various known dyes that spectrally sensitize silver halide. Sensitization may be in the visible or infra-red. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ moles, per mole of silver halide.

The Non-Photosensitive Reducible Silver Source Material

As noted above, the non-photosensitive silver salt which can be used in the present invention is a silver salt which is comparatively stable to light, but forms a silver image when heated to 80° C. or higher in the presence of an exposed photocatalyst (such as silver atoms) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof, etc. Silver salts which are substitutable with a halogen atom or a hydroxyl group can also be effectively used. Preferred examples of the silver salts of aromatic carboxylic acids and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, or a silver salt of a thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen-substituted benzotriazole, such as a silver salt of 5-chlorobenzotriazole, etc., a silver salt of 1,2,4-triazole, of 1H-tetrazole as described in U.S. Pat. No. 4,220,709, a silver salt of imidazole and an imidazole derivative, and the like.

It is also convenient to use silver half soaps, of which an equimolar blend of silver behenate and behenic acid, prepared by precipitation from aqueous solution of the sodium salt of commercial behenic acid and containing about 14.5% silver, represents a preferred example. Transparent sheet materials made on transparent film backing require a transparent coating and for this purpose the silver behenate full soap, containing not more than about 4 or 5 wt % of free behenic acid and containing about 25.2 wt % silver may be used.

The method used for making silver soap dispersions is known in the art and is disclosed in *Research Disclosure*, April 1983, item no 22812; *Research Disclosure*, October 1983, item no. 23419; and U.S. Pat. No. 3,985,565.

The core-shell-type silver halide and the organic silver salt which are separately formed in a binder can be mixed prior to use to prepare a coating solution, but it is also effective to blend or homogenize them in an homogenizer for a long period of time. Further, it is also effective to use a process which comprises adding a halogen-containing compound to the core-shell-type silver halide and the organic silver salt prepared to partially convert the silver of the organic silver salt to silver halide.

Methods of preparing these silver halide and organic silver salts and manners of blending them are described in *Research Disclosure*, No. 17029, Japanese Patent Applications No. 32928/75 and 42529/76, U.S. Pat. No. 3,700,458, and Japanese Patent Applications Nos. 13224/74 and 17216/75.

The silver halide and the non-photosensitive reducible silver source material that form a starting point of development should be in "reactive association." By "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing preformed silver halide in accordance with this invention can be sensitized with spectral sensitizers as described above.

The source of reducible silver material generally constitutes from 15 to 70% by weight of the emulsion layer. It is preferably present at a level of 30 to 55% by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascotbit acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridine; bisphenols, e.g., bis(2-hydroxy-3-t-butyl-5-methylphenyl)methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl)propane;ascorbic acid derivatives, e.g., 1-ascorbylpalmitate, ascorbylstearate and unsaturated aldehydes and ketones; 3-pyrazolidones; and certain indane-1,3-diones.

The reducing agent should be present as 1 to 10% by weight of the imaging layer. In multilayer constructions, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

The dye-forming or releasing material may be any colorless or lightly colored compound that can be oxidized to a colored form, when heated, preferably to a temperature of from about 80° C. to about 250° C. (176° F. to 482° F.) for a duration of from about 0.5 to about 300 seconds. When used with a dye- or image-receiving layer, the dye can diffuse through emulsion layers and interlayers into the image-receiving layer of the dement of the invention.

Leuco dyes are one class of dye-releasing material that form a dye upon oxidation. Any leuco dye capable of being oxidized by silver ion to form a visible image can be used in the present invention. Leuco dyes that are both pH sensitive and oxidizable can be used, but are not preferred. Leuco dyes that are sensitive only to changes in pH are not included within scope of dyes useful in this invention because they are not oxidizable to a colored form.

As used herein, the term "change in color" includes: (1) a change from an uncolored or lightly colored state (optical density less than 0.2) to a colored state (an increase-in optical density of at least 0.2 units); and (2) a substantial change in hue.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. These classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415; 4,570,171; 4,622,395; and 4,647,525.

Another class of dye-releasing materials that form a dye upon oxidation are known as preformed-dye-release (PDR) or redox-dye-release (RDR) materials. In these materials, the reducing agent for the organic silver compound releases a preformed dye upon oxidation. Examples of these materials are disclosed in Swain, U.S. Pat. No. 4,981,775.

Also Useful are neutral, phenolic leuco dyes such as 2-(3,5-di-t-butyl-4-hydroxyphenyl)-4,5-diphenylimidazole, or bis(3,5-di-t-butyl-4-hydroxyphenyl)phenylmethane. Other phenolic leuco dyes useful in practice of the present invention are disclosed in U.S. Pat. Nos. 4,374,921; 4,460,681; 4,594,307; and 4,782,010.

Other leuco dyes may be used in imaging layers as well, for example, benzylidene leuco compounds cited in U.S. Pat. No. 4,923,792. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ mole-era liter$^{-1}$, and possess good compatibility and heat stability. The dyes are readily synthesized and the reduced leuco forms of the compounds are very stable.

Leuco dyes such as those disclosed in U.S. Pat. Nos. 3,442,224; 4,021,250; 4,022,617; and 4,368,247 are also useful in the present invention.

The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150 nm, and more preferably, by at least 200 nm. Any leuco dye capable of being oxidized by silver ion to form a visible dye is useful in the present invention as previously noted.

The dyes generated by the leuco compounds employed in the elements of the present invention are known and are disclosed, for example, in *The Colour Index*; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; and U.S. Pat. No. 4,478,927.

Leuco dye compounds may readily be synthesized by techniques known in the art. Suitable methods are disclosed, for example, in: F.X. Smith et at. *Tetrahedron Lett.* 1983, 24(45), 4951–4954; X. Huang., L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2),343; and T. Sohda et al. *Chem. Pharm. Bull.* 1983, 31(2) 560–5; H.A. Lubs *The Chemistry of Synthetic Dyes and Pigments*; Hafner; New York, NY; 1955 Chapter 5; in H. Zollinger *Color Chemistry: Synthesis, Properties and Applications of Organic Dyes and Pigments*; VCH; New York, NY; pp. 67–73, 1987, and in U.S. Pat. No. 5,149,807; and EPO Laid Open Application No. 0,244,399.

Further, as other image-forming materials, materials where the mobility of the compound having a dye part changes as a result of an oxidation-reduction reaction with silver halide, or an organic silver salt at high temperature can be used, as described in Japanese Patent Application No. 165054 (1984). Many of the above-described materials are materials wherein an image-wise distribution of mobile dyes corresponding to exposure is formed in the photosensitive material by heat development. Processes of obtaining visible images by transferring the dyes of the image to a dye-fixing material (diffusion transfer) have been described in the above-described cited patents and Japanese Patent Application Nos. 168,439 (1984) and 182,447 (1984).

Still further the reducing agent may be a compound that releases a conventional photographic dye coupler or developer on oxidation as is known in the art. When the heat developable, photosensitive element used in this invention is heat developed in a substantially water-free condition after or simultaneously with imagewise exposure, a mobile dye image is obtained simultaneously with the formation of a silver image either in exposed areas or in unexposed areas with exposed photosensitive silver halide.

The total amount of optional leuco dye used as a reducing agent utilized in the present invention should preferably be in the range of 0.5–25 weight percent, and more preferably, in the range of 1–10 weight percent, based upon the total weight of each individual layer in which the reducing agent is employed.

The Binder

The photosensitive core-shell-type silver halide and the organic silver salt oxidizing agent used in the present invention are generally added to at least one binder as described herein below.

The binder(s) that can be used in the present invention can be employed individually or in combination with one another. It is preferred that the binder be selected from polymeric materials, such as, for example, natural and synthetic resins and that the binder be sufficiently polar to hold the other ingredients of the emulsion in solution or suspension. The binder may be hydrophilic or hydrophobic.

A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders can be used individually or in combination with one another. Although the binder may be hydrophilic or hydrophobic, it is preferrably hydrophobic.

The binders are generally used at a level of from about 20 to about 80% by weight of the emulsion layer, and preferably, from about 30 to about 55% by weight. Where the proportions and activities of leuco dyes require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally, these polymers may be used in combination of two or more thereof. Such a polymer is used in an amount sufficient to carry the components dispersed therein, that is, within the effective range of the action as the binder. The effective range can be appropriately determined by one skilled in the art.

The generation of fog in photothermographic elements comprising a core-shell-type, photosensitive silver halide; a non-photosensitive, reducible source of silver; a reducing agent for the non-photosensitive, reducible source of silver; and a binder, can be further reduced by the addition of a fog-reducing amount of hydrobromic acid salts of nitrogen-containing heterocyclic ring compounds which are further associated with a pair of bromine atoms; a halogen molecule; or an organic haloamide.

The Hydrobromic Acid Salt of Nitrogen-Containing Heterocyclic Compounds which are Further Associated with a Pair of Bromine Atoms.

The central nucleus of the nitrogen-containing heterocyclic compounds of the present invention may be represented by any of the following formulae:

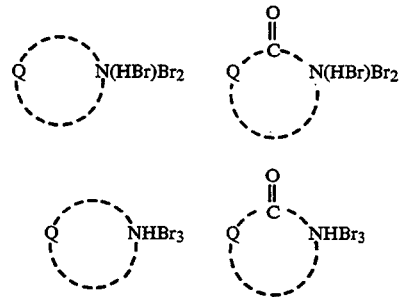

in which Q represents the atoms (preferably selected from C, S, N, Se, and O, more preferably C, N, and O) necessary to complete a 5-, 6-, or 7-membered heterocyclic ring group. This ring group may be monocyclic or polycyclic (especially bicyclic, with a fused-on benzene ring). The heterocyclic ring group may be unsubstituted or further substituted with such moieties as alkyl, alkoxy, and aryl groups, halogen atoms, hydroxy groups, cyano groups, nitro groups, and the like. Exemplary and preferred nitrogen-containing heterocyclic ring compounds include pyridine, pyrolidone, and pyrrolidinone. Other useful heterocyclic ring groups include, but are not limited to, pyrrolidines, phthalazinone, phthalazine, etc.

Preferred structures for use in the practice of the present invention may be defined by the formulae:

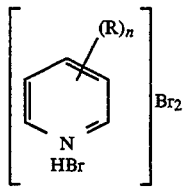

(1)

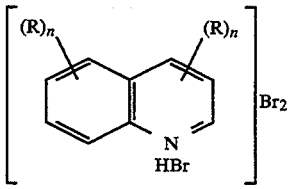

(2)

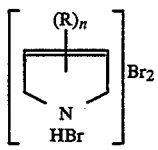

(3)

-continued (4)

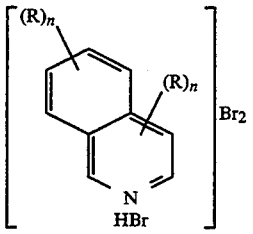

(5)

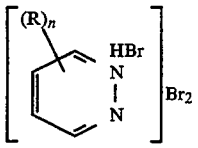

(6)

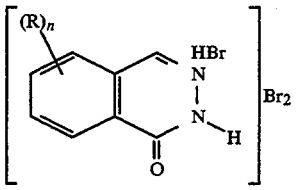

(7)

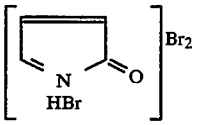

(8)

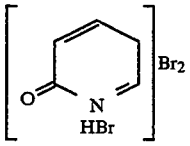

and the like, wherein each possible R group is independently selected form substituents such as alkyl groups, alkoxy groups, hydrogen, halogen, aryl groups (e.g., phenyl, naphthyl, thienyl, etc.) nitro, cyano, and the like. R substituents on adjacent positions may form fused ring groups so that formula (1) above would in fact be inclusive of formulae (2) and (4). n is zero or a whole positive integer such as 1, 2, 3, or4.

These compounds are used in general amounts of at least 0.005 mol per mole of silver halide in the emulsion layer. Usually the range is between 0.005 and 1.0 mol of the compound per mol of silver halide and preferably between 0.01 and 0.3 mol of antifoggant per mol of silver.

The Halogen Molecule

The halogen molecules which can be employed in this invention include iodine molecule, bromine molecule, iodine monochloride and iodine trichloride, iodine bromide and bromine chloride. The bromine chloride is preferably used in the form of a hydrate which is solid.

The term "halogen molecule" as used herein includes not only the above-described halogen molecules, but also complexes of a halogen molecule, for example, complexes of a halogen molecule with p-dioxane which are generally void. Of the halogen molecules that can be used in this invention, iodine molecule which is solid under normal conditions is especially preferred.

The Organic Haloamide Compounds

The organic haloamide compounds which can be employed in this invention include, for example, N-chlorosuccinimide, N-bromosuccinimide, N-iodosucinimide, N-chlorophthalimide, N-bromophthalimide, N-iodophthalimide, N-chlorophthalazinone, N-bromophthalazinone, N-iodophthalazinone, N-chloroacetamide, N-bromoacetamide, N-iodoacetamide, N-chloroacetanilide, N-bromoacetanilide, N-iodoacetanilide, 1-chloro-3,5,5,-trimethyl-2,4-imidazolidinedione, 1-bromo-3,5,5,-trimethyl-2,4-imidazonidinedionel-iodo-3,5,5,-trimethyl-2,4-imidazolidinedione, 1,3-di-chloro-5,5-dimethyl-2,4-imidazolidinedione, 1,3-dibromo-5,5-dimethyl-2,4-imidazolidinedione, 1,3-dibromo-5,5-dimethylimidazolidinedione, N,N-dichlorobenzenesulfonamide, N,N-dibromobenzenesulfonamide, N-bromo-N-methylbenzenesulfonamide, N-chloro-N-methylbenzenesulfonamide, N,N-diiodobenzenesulfonamide, N-iodo-N-methylbenzenesulfonamide, 1,3-dichloro-4,4-dimethylhydantoin, 1,3-dibromo-4,4-dimethylhydantoin, and 1,3-diiodo-4,4-dimethylhydantoin.

In general, the halogen molecules are more effective for improving both the sensitivity and the storage stability of the photosensitive materials than the organic haloamide compounds. The amount of the halogen molecules or the organic haloamide compounds typically ranges from about 0.001 mole to about 0.5 mole, and preferably from about 0.01 mole to about 0.2 mole, based on the mole of the organic silver salt oxidizing agent.

Dry Silver Formulations

The formulation for the photothermographic emulsion layer can be prepared by dissolving and dispersing the binder, the photosensitive core-shell-type silver halide, the non-photosensitive source of reducible silver, the reducing agent for the non-photosensitive reducible silver source (such as, for example, the optional leuco dye), and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferably from 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl-)aryldicarboximides, e.g. (N,N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylenebis(1-carbamoyl-3,5-dimethylpyrazole), 1,8-(3,6-diaza-octane)bis(isothiuronium)trifluoroacetate and 2-(tribromomethylsulfonyl benzothiazole); and merocyanine dyes such as 3-ethyl-5-[(3-ethyl-2-benzothiazolinylidene)-1-methyl-ethylidenel-2-thio-2,4-oazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlorodate (III), rhodium bromide, rhodium nitrate and potassium hexachlorodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H, 4H-2,3a,5,6a-tetrazapentalene, and 1,4-di(o-chlorophenyl)-3,6-dimercapto-1H, 4H-2,3a,5,6a-tetrazapentalene.

Photothermographic emulsions used in this invention may be further protected against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mercuric bromide.

Suitable antifoggants and stabilizers, which can be used alone or in combination, include the thiazolium salts described in U.S. Pat. Nos. 2,131,038 and U.S. Pat. No. 2,694,716; the azaindenes described in U.S. Pat. Nos. 2,886,437 and 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Emulsions used in the invention may contain plasticizers and lubricants such as polyalcohols, e.g., glycerin and diols of the type described in U.S. Pat. No. 2,960,404; fatty acids or esters such as those described in U.S. Pat. Nos. 2,588,765 and 3,121,060; and silicone resins such as those described in British Patent No. 955,061.

The photothermographic elements of the present invention may include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

Photothermographic elements according to the present invention can be used in photographic elements which contain light-absorbing materials and filter dyes such as those described in U.S. Pat. Nos. 3,253,921; 2,274,782; 2,527,583; and 2,956,879. If desired, the dyes can be mordanted, for example, as described in U.S. Pat. No. 3,282,699.

Photothermographic elements described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

Photothermographic Constructions

The photothermographic dry silver elements of this invention may be constructed of one or more layers on a substrate. Single layer constructions should contain the silver source material, the core-shell-type silver halide, the developer, and at least one compound selected from the group consisting of: hydrobromic acid salts of nitrogen-containing heterocyclic compounds which are further associated with a pair of bromine atoms; a halogen molecule; or an organic haloamide; and binder as well as optional materials such as toners, dye-forming materials, coating aids, and other adjuvants. Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic elements, the various emulsion layers are generally maintained distinct from each other by the use of functional or non-functional barrier layers between the various photosensitive layers as described in U.S. Pat. No. 4,460,681.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and, more preferably, in the range 0.5 to 2.5, as measured by a MacBeth Color Densitometer Model TD 504. When used in color elements, a color filter complementary to the dye color should be used.

Additionally, it may be desirable in some instances to coat different emulsion layers on both sides of a transparent substrate, especially when it is desirable to isolate the imaging chemistries of the different emulsion layers.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

The substrate with backside resistive heating layer may also be used in color photothermographic imaging systems such as shown in U.S. Pat. Nos. 4,460,681 and 4,374,921.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support or substrate can be selected from a wide range of materials depending on the imaging requirement. Substrates may be transparent or opaque. Typical supports include polyester film, subbed polyester film, polyethylene terephthalate film, cellulose nitrate film, cellulose ester film, polyvinyl acetal film, polycarbonate film and related or resinous materials, as well as glass, paper, metal and the like. Typically, a flexible support is employed, especially a paper support, which can be partially acetylated or coated with baryta and/or an $\alpha$-olefin polymer, particularly a polymer of an alpha-olefin containing 2 to 10 carbon atoms such as polyethylene, polypropylene, ethylene-butene copolymers, and the like. Preferred polymeric materials for the support include polymers having good heat stability, such as polyesters. A particularly preferred polyester is polyethylene terephthalate.

The Image-Receiving Layer

The photothermographic element may further comprise an image-receiving layer. Images derived from the photothermographic elements employing compounds capable of being oxidized to form or release a dye, such as, for example, leuco dyes, are typically transferred to an image-receiving layer.

When the reactants and reaction products of photothermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This "background stain" is caused by slow reaction between the dye-forming or dye-releasing compound and reducing agent during storage. It is therefore desirable to transfer the dye formed upon imaging to a receptor, or image-receiving layer.

The image-receiving layer of this invention can be any flexible or rigid, transparent layer made of thermoplastic polymer. The image-receiving layer preferably has a thickness of at least 0.1 $\mu$m, more preferably from about 1 to about 10 $\mu$m, and a glass transition temperature ($T_g$) of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably, from 1.5 to 3.5) or a transmission optical density in the range of from 0.2 to 2.5 (preferably, from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image-receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", (a fluorinated surfactant, available from 3M Company, St. Paul, MN). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated shoe-and-roller type heat processor.

Multi-layer constructions containing blue-sensitive emulsions containing a yellow leuco dye of this invention may be overcoated with green-sensitive emulsions containing a magenta leuco dye of this invention. These layers may in turn be overcoated with a red-sensitive emulsion layer containing a cyan leuco dye. Imaging and heating form the yellow, magenta, and cyan images in an imagewise fashion. The dyes so formed may migrate to an image-receiving layer. The image-receiving layer may be a permanent part of the construction or may be removable "i.e., strippably adhered" and subsequently peeled from the construction. Color-forming layers may be maintained distinct from each other by the use of functional or non-functional barrier layers between the various photosensitive layers as described in U.S. Pat. No. 4,460,681. False color address, such as that shown in U.S. Pat. No. 4,619,892, may also be used rather than blue-yellow, green-magenta, or red-cyan relationships between sensitivity and dye formation.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Alternatively, a multi-colored image may be prepared by superimposing in register a single image-receiving sheet successively with two or more imagewise exposed photothermographic or thermographic elements, each of which release a dye of a different color, and heating to transfer the released dyes as described above. This method is particularly suitable for the production of color proofs especially when the dyes released have hues which match the internationally-agreed standards for color reproduction (SWOP colors). Dyes with this property are disclosed in U.S. Pat. No. 5,023,229. In this embodiment, the photothermographic or thermographic element preferably comprise compounds capable of being oxidized to release a preformed dye as this enables the image dye absorptions to be tailored more easily to particular requirements of the imaging system. When used in a photothermographic dement, the elements are preferably all sensitized to the same wavelength range regardless of the color of the dye released. For example, the elements may be sensitized to ultra-violet radiation with a view toward contact exposure on conventional printing frames, or they may be sensitized to longer wavelengths, especially red or near infra-red to enable digital address by lasers.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

All materials used in the following examples were readily available from standard commercial sources such as Aldrich Chemical Co. (Milwaukee, WI) unless otherwise specified. The following additional terms and materials were used.

- Acryloid TM B-66 is a poly(methyl methacrylate) available from Rohm and Haas, Philadelphia, PA..
- Airvol TM 523 is a poly(vinyl alcohol) available from Air Products, Allentown, PA.
- Butvar TM B-76 is a poly(vinyl butyral) available from Monsanto Company, St. Louis, MO.
- Desmodur TM N3300 is an isocyanate resin available from Mobay Chemicals, Pittsburgh, PA.
- MEK is methyl ethyl ketone (2-butanone).
- PAZ is 1-(2H)-phthalazinone.
- PET is poly(ethylene terephthalate)
- PVP K-90 is a poly(vinyl pyrrolidone) available from International Specialty Products.
- Styron 685D is a polystyrene resin available from Dow Chemical Company, Midland, MI.
- VAGH is a vinyl chloride/vinyl acetate copolymer available from Union Carbide Corp., Danbury, CT.

Dye-1 has the following structure (disclosed in G.B. Patent Appln. No. 305324.7, filed March 16, 1993):

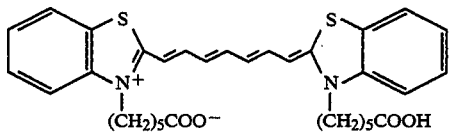

Dye 1

"Ethyl ketazine" is described in U.S. Pat. Nos. 4,587,211 and 4,795,697 and has the following formula:

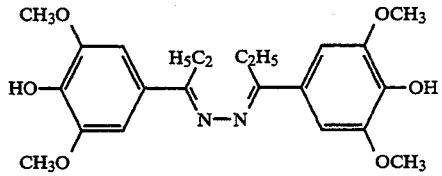

EXAMPLE 1

Preparation of Non-Core-Shell-Type Silver Iodobromide Emulsions: Comparative non-core-shall-type silver iodobromide emulsions 1-A, 1-B, and 1-C were prepared by double-jet addition in aqueous phthalated gelatin solution at controlled pAg and temperature conditions by the following procedure. These examples demonstrate that higher silver iodide content non-core-shell-type emulsions results in thermal fogging of the emulsion.

To a first solution (Solution A) having 50–100 g of phthalated gelatin dissolved in 1500 ml of deionized water, held at a temperature between 30°–38° C., were simultaneously added; a second solution (Solution B) containing predetermined amounts of potassium iodide and potassium bromide; and a third solution (Solution C) which was an aqueous solution containing 1.4 to 1.8 moles of silver nitrate ($AgNO_3$) per liter. pAg was held at a constant value by means of a pAg feedback control loop as described in *Research Disclosure* No. 17643; U.S.

Pat. Nos. 3,415,650; 3,782,954; and 3,821,002. The size of the emulsion grains being formed were adjusted by controlling the addition rates, silver nitrate concentration, gelatin concentration in the kettle, and the kettle temperature.

As a result, three silver iodobromide emulsions were obtained that were cubic, monodispersed silver halide having different silver iodide (AgI) contents, but of the same grain size. These emulsions were washed with water and desalted.

Table 1-1 shows the comparative emulsions 1-A, 1-B, and 1-C as to pAg at make, the average grain size, and the silver iodide content.

TABLE 1-1

| Example | pAg | Average grain size | AgI Content: mole % |
|---|---|---|---|
| 1-A | 2 | 0.04μ m | 2 |
| 1-B | 8.2 | 0.04μ m | 2 |
| 1-C | 2 | 0.04μ m | 3.5 |

Preparation of Core-Shell-Type Silver Iodobromide Emulsion: Nine core- shell-type emulsions, 1-D to 1-L having different silver iodide content were prepared by the following procedure.

To a first solution (Solution A) having 50–100 g of phthalated gelatin dissolved in 1500 ml of deionized water, held at a temperature between 30°–38° C., were simultaneously added; a second solution (Solution B) containing predetermined amounts of potassium bromide and potassium iodide, and a third solution (Solution C) which was an aqueous solution containing 1.4 to 1.8 moles silver nitrate per liter. pAg was held at a constant value by means of a pAg feedback control loop as described in *Research Disclosure* No. 17643, U.S. Pat. Nos. 3,415,650; 3,782,954; and 3,821,002. After a certain percentage of the total delivered silver nitrate was added, the second halide solution (Solution B), was replaced with Solution D which contained different predetermined amounts of potassium iodide and potassium bromide; and Solution C was replaced with Solution E. In this manner a core of particular silver iodide percentage with a shell of different silver iodide percentage could be obtained.

Since pAg was an area of interest as to its effect on the subsequent use of the silver halide emulsions in photothermographic constructions, the emulsions investigated were made at two different pAg's. As previously described, the sizes of the emulsion grains were adjusted by controlling the addition rates, silver nitrate concentration, gelatin concentration in the kettle, and the kettle temperature. As a result, nine monodispersed core-shell-type emulsions were obtained. They differed only in pAg during make, total amount of silver iodide distributed in between the core and shell, and the portion of the grain designated as the core vs. shell.

For illustration, the procedure for the preparation of 2 moles of emulsion 1-E is shown below.

Solution A was prepared at 32° C. as follows:
- gelatin 50 g
- aleionized Water 1500 ml
- 0.1 M KBr 6 ml
- adjust to pH=5.0 with 3N $HNO_3$ Solution B was prepared at 25° C. as follows:
- KBr 27.4 g
- KI 3.3 g
- deionized Water 275.0 g Solution C was prepared at 25° C. as follows:
- $AgNO_3$ 42.5 g
- deionized Water 364.0 g Solutions B and C were jetted into Solution A over 9.5 minutes.

Solution D was prepared at 25° C. as follows:
- KBr 179. g
- deionized Water 812. g Solution E was prepared at 25° C. as follows:
- $AgNO_3$ 127. g
- deionized Water 1090. g Solutions D and E were jetted into Solution A over 28.5 minutes.

The emulsions were washed with water and then desalted. The average grain size, pAg at make, and silver iodide content of each of the core-shell-type silver halide emulsions, 1-D to 1-L, are shown in Table 1-2. Silver halide grain size was determined by Scanning Electron Microscopy (SEM).

TABLE 1-2

| Example | Core Iodide mole % | Core Silver mole % | Shell Halide mole % | Silver in Shell mole % | Total Iodide mole % | pAg | Average Grain Size, μm |
|---|---|---|---|---|---|---|---|
| 1-D | 6 | 25 | 100% Br | 75 | 1.5 | 8.2 | 0.05 |
| 1-E | 8 | 25 | 100% Br | 75 | 2 | 8.2 | 0.04 |
| 1-F | 16 | 12.5 | 100% Br | 87.5 | 2 | 8.2 | 0.04 |
| 1-G | 8 | 25 | 100% Br | 75 | 2 | 2 | 0.04 |
| 1-H | 6 | 25 | 2% I/98% Br | 75 | 3 | 8.2 | 0.04 |
| 1-I | 6 | 50 | 100% Br | 50 | 3 | 8.2 | 0.04 |
| 1-J | 6 | 50 | 100% Br | 50 | 3 | 2 | 0.04 |
| 1-K | 14 | 25 | 100% Br | 75 | 3.5 | 8.2 | 0.04 |
| 1-L | 14 | 25 | 100% Br | 75 | 3.5 | 2 | 0.04 |

Preparation of Preformed Silver Halide/Silver Organic Salt Dispersion

A silver halide/silver organic salt dispersion was prepared as described below. This material is also referred to as a silver soap dispersion or emulsion.

I. Ingredients
1. Preformed silver halide emulsion (non-core-shell Examples 1A-1C; Core-Shell Examples 1D-1L) 0.22 mole at 700 g/mole in 1.25 liter $H_2O$ at 42° C.
2. NaOH 89.18 g in 1.50 liter $H_2O$
3. $AgNO_3$ 364.8 g in 2.5 liter $H_2O$
4. Fatty acid 131 g (Humko Type 9718) [available from Witco. Co., Memphis, TN]
5. Fatty acid 634.5 g (Humko Type 9022) [available from Witco. Co., Memphis, TN]
6. $HNO_3$ 19 ml in 50 ml $H_2O$ II. Reaction
1. Dissolve ingredients #4 and #5 at 80° C. in 13 liter of $H_2O$ and mix for 15 minutes.
2. Add ingredient #2 to Step 1 at 80° C. and mix for 5 minutes to form a dispersion.

3. Add ingredient #6 to the dispersion at 80° C., cooling the dispersion to 55° C. and stirring for 25 minutes.
4. Add ingredient #1 to the dispersion at 55° C. and mix for 5 minutes.
5. Add ingredient #3 to the dispersion at 55° C. and mix for 10 minutes.
6. Wash until wash water has a resistivity of 20,000 ohm/cm$^{-2}$.
7. Dry at 45° C. for 72 hours.

Homogenization of Preformed Soaps (Homogenate): A preformed silver fatty acid salt homogenate was prepared by homogenizing 200 g of pre-formed soaps, prepared above, in solvent and Butvar TM B-76 poly(vinyl butyral) according to the following procedure.

1. Add 200 g of preformed soap to 350 g of toluene, 1116 g of 2-butanone, and 33 g of Butvar TM B-76.
2. Mix the dispersion for 10 minutes and hold for 24 hours.
3. Homogenize at 4000 psi.
4. Homogenize again at 8000 psi.

Preparation of Photothermographic Light Sensitive Material: The homogenized photothermographic emulsion (200g) and 50 ml 2-butanone were cooled to 55° F. with stirring. Butvar TM B-76 (30.2g) was added and the mixture was stirred for 20 minutes. Pyridinium hydrobromide perbromide (PHP, 0.18g) was added and stirred for 2 hours. The addition of 1.30 ml of a calcium bromide solution (1 g of $CaBr_2$ and 10 ml of methanol) was followed by 16 hours of stirring at 55° F. The following were then added in 15 minute increments with stirring:

1.0 g of 2-(4-chlorobenzoyl)benzoic acid
0.0168 g IR Dye-1
0.084 g 2-mercapto-(5-methylbenzimidazole) in 5 g methanol
6.56 g 1,1-bis(2-hydroxy-3,5-dimethylphenyl)-3,5,5-trimethylhexane
0.70 g 5-tribromomethylsulphonyl-2-methyl- 1,3,4-thiadiazole
0.272 g Desmodur TM N3300 isocyanate A protective topcoat solution was prepared with the following ingredients:

256.0 g acetone
123.0 g 2-butanone
50.0 g methanol
20.2 g cellulose acetate
2.89 g phthalazine
1.52 g 4-methylphthalic acid
1.01 g tetrachlorophthalic acid
1.50 g tetrachlorophthalic anhydride Coating of Photothermographic Light Sensitive Material: The photothermographic emulsions were coated on 3 mil (76.2 μm) polyester base by means of a knife coater and dried at 175° F. for four minutes. The dry coating weight was 23 g/m$^2$ and the silver coating weight was 2.0 g/m$^2$.

The topcoat solution was then coated over the silver-containing layer. The dry weight was 3.0 g/m$^2$. The layer was dried at 175° F. for four minutes.

Sensitometric and Thermal Stability Measurements: The sensitometry of samples of freshly coated materials was determined by exposure with a laser sensitometer incorporating a 780 nm laser diode. After exposure, the samples were developed by heating at 250° F. (121 ° C.) for 15 seconds to give an image.

Densitometry measurements were made on a custom-built, computer-scanned densitometer and are believed to be comparable to measurements obtainable from commercially available densitometers. Sensitometric results include $D_{min}$, $D_{max}$, speed, contrast, and $\Delta D_{min}$.

$D_{min}$ is the density corresponding to an exposure at 1.40 log E beyond a density of 0.25 above $D_{min}$.

Speed is the relative speed at a density of 1.0 above $D_{min}$ versus coating 1-A setat 100.

Contrast is measured by the slope of the line joining the density points of 0.50 and 1.70 above $D_{min}$.

$\Delta D_{min}$ is the change in $D_{min}$ of samples aged in an oven for 14 days at 120° F./50% RH minus $D_{min}$ of the non-aged samples.

Accelerated aging studies are a very good method of determining the degree of thermal fog that might result from natural storage and aging. Unexposed strips, prepared above, were aged in ovens maintained at 120° F./50% relative humidity (%RH). After 14 days, the samples were removed, exposed, and processed in a manner similar to the freshly coated samples. Of considerable interest was the $D_{min}$ that results due to accelerated oven testing.

The results, shown in table 1-3, indicate that uniformly distributed silver iodide emulsions are generally not as good in regards to sensitometry or $D_{min}$ stability upon oven aging (known as $\Delta D_{min}$). However, it can be seen that much better results are obtained when one distributes the silver iodide in a core-shell-type manner. In particular, emulsions made at pAg 2 or pAg 8.2 seem equally good regarding $D_{min}$ or $\Delta D_{min}$ unless the silver iodide in the core is higher than 14% as shown by 1-F or as one starts to approach 4 mole % overall silver iodide content as shown in Example 1-L.

TABLE 1-3

| Experiment No. | $D_{min}$ | $D_{max}$ | Speed | Relative Speed | Contrast | Delta $D_{min}$ |
|---|---|---|---|---|---|---|
| 1-A | 0.153 | 3.05 | 2.46 | 100 | 3.35 | >0.2 |
| 1-B | 0.111 | 3.60 | 2.36 | 79 | 3.91 | 0.04 |
| 1-C | 0.120 | 3.90 | 2.51 | 112 | 4.60 | >0.2 |
| 1-D | 0.106 | 3.63 | 2.58 | 132 | 4.34 | 0. |
| 1-E | 0.097 | 3.62 | 2.42 | 91 | 4.97 | 0.04 |
| 1-F | 0.101 | 3.68 | 2.61 | 141 | 3.68 | 0.1 |
| 1-G | 0.116 | 3.86 | 2.60 | 138 | 4.36 | 0. |
| 1-H | 0.097 | 3.51 | 2.38 | 83 | 4.00 | 0.01 |
| 1-I | 0.092 | 3.52 | 2.50 | 110 | 2.89 | 0.01 |
| 1-J | 0.091 | 3.56 | 2.41 | 89 | 3.86 | 0.01 |
| 1-K | 0.108 | 3.69 | 2.48 | 105 | 4.21 | 0. |
| 1-L | 0.104 | 3.67 | 2.63 | 148 | 3.65 | 0.08 |

EXAMPLE 2

Preparation of Core-Shell-Type Iodobromide Emulsion: Four core-shell-type emulsions, labeled 2-A to 2-D, having different silver iodide contents were prepared according to the procedures described in Example 1. A higher kettle temperature was used to obtain a larger average grain size.

As a result, 4 monodispersed core-shell-type emulsions were obtained. Table 2-1 shows the core and shell silver iodide content, pAg, total mole % silver iodide, and average grain size.

Sensitometric and Thermal Stability Measurements: Emulsions 2-A to 2-D were prepared as pre-formed soaps and formulated into photothermographic light sensitive elements as described in Example 1. The samples were coated, exposed, and processed as described in Example 1. The results, shown in Table 2-2, indicate that initial $D_{min}$ is very much affected by grain size and also higher silver iodide percentage.

TABLE 2-1

| Example | Core Iodide mole % | Core Silver mole % | Shell Halide mole % | Silver in Shell mole % | Total Iodide mole % | pAg | Average Grain Size, μm |
|---|---|---|---|---|---|---|---|
| 2-A | 8 | 25 | 100% Br | 75 | 2 | 2 | 0.08 |
| 2-B | 8 | 25 | 2% I/98% Br | 75 | 3 | 2 | 0.08 |
| 2-C | 12 | 25 | 100% Br | 75 | 3 | 2 | 0.08 |
| 2-D | 12 | 25 | 2% I/98% Br | 75 | 4.5 | 2 | 0.08 |

TABLE 2-2

| Experiment No. | $D_{min}$ | $D_{max}$ | Speed | Relative Speed | Contrast | Δ $D_{min}$ |
|---|---|---|---|---|---|---|
| 2-A | 0.115 | 3.32 | 2.96 | 316 | 3.15 | 0.02 |
| 2-B | 0.167 | 3.37 | 3.04 | 380 | 3.24 | |
| 2-C | 0.161 | 3.27 | 2.97 | 325 | 2.95 | |
| 2-D | 0.182 | 3.20 | 2.80 | 174 | 2.77 | |

EXAMPLE 3

Core-Shell-Type Silver Halide Emulsion with Silver Iodide Core and Silver Chlorobromide Shell: A core-shell-type emulsion, 3-A, was prepared according to the procedures described in Example 1. The main difference was that solution D contained a mixture of potassium bromide and potassium chloride. As shown in Table 3,1, the ratio of KCl to KBr was 35 mol % Cl and 65 mol % Br. As a result, a monodispersed core-shell-type emulsion was obtained. Table 3-1 shows the core and shell silver iodide Content, pAg, total % silver iodide, % silver chloride, and % silver bromide in the shell, and average grain size.

Emulsion 3-A was prepared as a pre-formed soap and formulated into a photothermographic, light-sensitive film as described in Example 1. The samples were coated, exposed, and processed as described in Example 1. The results, shown in Table 3-2, indicate that the shell can also be silver chloride/silver bromide.

TABLE 3-2

| Experiment No. | $D_{min}$ | $D_{max}$ | Speed | Relative Speed | Contrast | Delta $D_{min}$ |
|---|---|---|---|---|---|---|
| 3-A | 0.110 | 3.55 | 2.71 | 178 | 3.14 | 0.01 |

TABLE 3-1

| Example | Core Iodide mole % | Core Silver mole % | Shell Halide mole % | Silver in Shell mole % | Total Iodide mole % | pAg | Average Grain Size, μm |
|---|---|---|---|---|---|---|---|
| 3-A | 6 | 25 | 35% Cl/65% Br | 75 | 1.5 | 8.2 | 0.06 |

EXAMPLE 4

Color Photothermographic Material: A silver formulation was prepared by using 200 g of pre-formed core-shell-type emulsions 1-G and 1-F with the following ingredients, each added in its listed order with mixing for the time given at 55° F. (12.8° C.).

40 g 2-butanone (methyl ethyl ketone) and 25 g Butvar TM B-76 were mixed for minutes.

0.055 g pyridinium hydrobromide perbromide was added and the mixture was held for 1 hour.

An additional 0.055 g pyridinium hydrobromide perbromide was added and the mixture held for 1 hour.

An additional 0,055 g pyridinium hydrobromide perbromide was added and the mixture held for 4 hours.

0.13 g calcium bromide was added and the mixture was held for 1 hour.

0.4 g 2-bromobutyl-2'-tribromomethylsulfone was added and the mixture held overnight.

0.7 g 2-quinoline-tribromomethylsulfone was added and the mixture held for minutes.

0.6 g 2-(4-chlorobenzoyl)benzoic acid, 0.1 g of 2-mercaptobenzoimidazole, and 0.029 g Dye-1 in 5 g methanol was added and the mixture held for 15 minutes.

A second solution was prepared separately by mixing of the following reagents:

0.9 g ethyl ketazine
1.8 g phthalazinone
80.0 g tetrahydrofuran
6.3 g VAGH
4.0 g Butvar TM poly(vinyl butyral)

The silver formulation, 6 g, was then mixed with 13.5 g of the second solution and coated at 2 rail (50.8 μm) wet thickness, and dried at 170° F. for 4 minutes.

A protective topcoat solution was prepared with the following ingredients:

53.56% acetone
26.44% 2-butanone
10.68% toluene
8.65% Styron TM 685D Polystyrene The topcoat was then coated at 2 mil (50.8 μm) wet thickness over the silver layer and dried at 170° F. (76.7° C.) for 4 minutes. The resulting film was exposed on an EG&G Sensitometer at 780 nm through a narrow bandpass filter for $10^{-3}$ seconds and processed at 136° C. for 16 seconds to give a magenta image. The sensitometric response is shown in Table 4-1.

| Emulsion | $D_{min}$ | $D_{max}$ | Speed | Contrast |
|---|---|---|---|---|
| 1-G | 0.09 | 2.28 | 1.43 | 4.97 |
| 1-F | 0.17 | 2.37 | 1.27 | 5.89 |

The results indicate that core-shell-type silver halide emulsions can be used to form colored images in photothermographic elements. Sample 1-F demonstrates that cores having an silver iodide concentration greater than 14% result in undesirably high $D_{min}$.

Reasonable modifications and variations are possible from the foregoing disclosure without departing from either the spirit or scope of the present invention as defined by the claims.

What is claimed is:

1. A negative-acting, photothermographic element comprising a support bearing at least one heat-developable, photosensitive, image-forming photothermogrpahic emulsion layer consisting essentially of:

(a) preformed core-shell-type, photosensitive silver halide grains containing a total silver iodide content of less than 4 mole %, said core having a first silver iodide content of from about 4–14 mole % based upon the total amount of silver halide in said core, said shell having a second silver iodide content lower than the silver iodide content of said core;

(b) a non-photosensitive, reducible source of silver;

(c) a reducing agent for said non-photosensitive, reducible source of silver;

(d) a binder; and (e) at least one compound selected from the group consisting of: a halogen molecule; an organic haloamide; and hydrobromic acid salts of nitrogen containing heterocyclic compounds which are further associated with a pair of bromine atoms.

2. The photothermographic element according to claim 1 wherein said core contains up to 50 mole % of the total amount of silver present in said silver halide grains.

3. The photothermographic element according to claim 2 wherein core contains about 20–30 mole % of the total amount of silver present in said silver halide grains.

4. The photothermographic element according to claim 3 wherein said core contains about 25 mole % of the total amount of silver present in said silver halide grains.

5. The photothermographic element according to claim 1 wherein said shell further comprises silver bromide, silver chloride, or silver chlorobromide.

6. The photothermographic element according to claim 1 wherein said silver halide grains have an average diameter of less than about 0.1 μm.

7. The photothermographic dement according to claim 6 wherein said silver halide grains are between about 0.02 to 0.08 μm in average diameter.

8. The photothermographic dement according to claim 1 wherein said silver halide grains are sensitized to visible or infrared light.

9. The photothermographic element according to claim 1 wherein said non-photosensitive, reducible silver source is present in said photothermographic element in an amount of from about 60 to 99 weight %.

10. The photothermographic element according to claim 9 wherein said non-photosensitive, reducible silver source is present in said photothermographic element in an amount of from about 85 to 95 weight %.

11. The photothermographic element according to claim 1 wherein said non-photosensitive, reducible silver source is a silver salt of a carboxylic acid containing from 10 to 30 carbon atoms.

12. The photothermographic element according to claim 11 wherein said silver salt is silver behenate.

13. The photothermographic element according to claim 1 wherein said reducing agent for silver ion comprises a dye-releasable material capable of being oxidized to form or release a dye.

14. The photothermographic element according to claim 13 where said dye-releasable material is a leuco dye.

15. The photothermographic element according to claim 1 wherein said binder is hydrophobic.

16. The photothermographic dement according to claim 1 wherein the silver iodide content of said shell is at least about 2–12 mole % lower than the silver iodide content of said core.

17. The photothermographic element according to claim 1 wherein said compound in (e) is one or more hydrobromic acid salts of a nitrogen-containing heterocyclic compound associated with a pair of bromine atoms.

18. The photothermographic element according to claim 17 wherein said nitrogen-containing heterocyclic compound associated with a pair of bromine atoms is pyridinium hydrobromide perbromide.

19. The photothermographic element according to claim 1 wherein said compound in (e) is a halogen molecule.

20. The photothermographic element according to claim 19 wherein halogen molecule is at least one compound selected from the group consisting of molecular iodine, molecular bromine, iodine monochloride, iodine trichloride, iodine bromide, and bromine chloride.

21. The photothermographic dement according to claim 20 wherein said halogen molecule is molecular iodide.

22. The photothermographic element according to claim 1 wherein said compound in (e) is an organic haloamide.

23. The photothermographic dement according to claim 22 wherein said organic haloamide is N-bromosuccinimide.

* * * * *